US005356016A

United States Patent [19]

Wiedemann

[11] Patent Number: 5,356,016

[45] Date of Patent: Oct. 18, 1994

[54] BABY NURSING BOTTLE

[76] Inventor: Warren T. Wiedemann, 62 Spring Valley Rd., Paramus, N.J. 07652

[21] Appl. No.: 796,071

[22] Filed: Nov. 20, 1991

[51] Int. Cl.[5] ..... A61J 9/00

[52] U.S. Cl. ..... 215/11.3; 215/11.1; 222/95; 222/386

[58] Field of Search ..... 215/11.1, 11.2, 11.3, 215/11.5; 222/95, 386, 387; 92/90

[56] References Cited

U.S. PATENT DOCUMENTS

| | | | |
|---|---|---|---|
| 2,853,209 | 9/1958 | McArdle | 215/11.1 X |
| 3,093,256 | 6/1963 | Woodbury, Jr. | 215/11.1 |
| 3,395,822 | 8/1968 | Donleavy . | |
| 3,648,873 | 3/1972 | Grobbel . | |
| 3,955,698 | 5/1976 | Hammer . | |
| 3,998,348 | 12/1976 | Sammaritano | 215/11.3 |
| 4,010,861 | 3/1977 | Welten | 215/11.5 |
| 4,176,754 | 12/1979 | Miller . | |
| 4,239,132 | 12/1980 | Mueller et al. . | |
| 4,339,046 | 7/1982 | Coen | 215/11.5 |
| 4,759,453 | 7/1988 | Paetzold | 215/11.1 |
| 4,796,767 | 1/1989 | McKeown . | |
| 4,815,615 | 3/1989 | Phlaphongphanich | 215/11.1 |
| 4,832,214 | 5/1989 | Schrader et al. | 215/11.1 |
| 4,880,125 | 11/1989 | LeBeau . | |
| 4,979,629 | 12/1990 | Askerneese . | |
| 4,984,697 | 1/1991 | Kelly | 215/11.1 |
| 5,033,631 | 7/1991 | Nightingale | 215/11.1 |
| 5,044,509 | 9/1991 | Petrosky et al. | 215/11.1 X |

*Primary Examiner*—Allan N. Shoap
*Assistant Examiner*—Vanessa Caretto

[57] ABSTRACT

A baby nursing bottle for being used in conjunction with collapsible liquid containers such as small disposable plastic bags. The baby nursing bottle comprises a cylindrical main body portion and a pair of longitudinal slots in the main body portion. The slots extend substantially along the length of the main body portion. A longitudinally movable plunger member is positioned within the main body portion, and a pair of tab handles are connected to the plunger and extend outwardly from the slots adjacent the outer surface of the main body portion for moving the plunger longitudinally within the main body portion when the tab handles are engaged and moved along the surface of the main body portion.

19 Claims, 3 Drawing Sheets

BABY NURSING BOTTLE

FIELD OF THE INVENTION

The present invention relates to baby nursing bottles, and in particular relates to a baby nursing bottle which can incorporate a collapsible plastic bag to hold a fluid in the bottle, and which also incorporates a means for expelling air from the collapsible bag so that only the liquid remains for feeding.

BACKGROUND OF THE INVENTION

Conventional bottles for feeding infants have for years consisted of solid plastic or glass bottles into which the liquid is placed directly, after which the bottle is topped by an appropriate nipple assembly from which an infant can feed. As known to those of ordinary skill in this art—parents—such conventional bottles naturally fill with air as the infant drinks the liquid. In turn, the feeding infant tends to swallow some of the air, causing indigestion.

As an improvement on this long existing configuration, a newer generation of baby nursing bottles consists of a polymeric cylinder into which a collapsible plastic bag can be positioned. The milk, formula, or other liquid is then added to the bag rather than to the cylinder. When topped with the appropriate nipple assembly, this arrangement desirably provides a system under which the bag gradually collapses as the infant feeds from the liquid therein. Because the bag collapses, there is a lesser tendency for air to enter it as an infant drinks. Ideally, this system helps an infant to swallow less air during feeding than the infant would when feeding from a noncollapsible bottle.

Nevertheless, an air content problem remains with such collapsible bag feeding systems in that during normal filling procedures, the collapsible bag can never be filled completely with liquid, and for several reasons. First, the dexterity required to fill the collapsible bag exactly to the top, but no further is somewhat unrealistic to expect during the normal circumstances surrounding feeding an infant. Perhaps more fundamentally, even if the collapsible bag could be exactly and totally filled with liquid, there is still an air space present that results when the nipple assembly is placed on the collapsible bag and the supporting plastic cylinder. Thus, some air almost always remains in the collapsible bag in spite of its other advantages.

Accordingly, a number of structures have been proposed for addressing this problem. In U.S. Pat. No. 3,648,873 to Grobbel a structure is proposed in which a plunger on a separate stand is used to purge air from such a nursing system.

Hammer, U.S. Pat. No. 3,955,698 show a relatively complex spring and plunger system for expelling air from such a nursing system.

Miller, U.S. Pat. No. 4,176,754 shows a "pneumatic biasing member" which attempts to solve the problem.

McKeown, U.S. Pat. No. 4,796,767 shows a pressure applicator having a generally L-shaped cross section for expelling air from the collapsible bag of such a nursing bottle.

Lebeau, U.S. Pat. No. 4,880,125 discloses a relatively straightforward plunger system, but which is rather extensive in length and which, when the bottle is full, effectively doubles the size of the nurser.

Finally, Askerneese, U.S. Pat. No. 4,979,629 discloses an air expeller system for a nursing bottle which includes a storage system for liners, a nipple, and premeasured portions of infant formula. Askerneese illustrates a measuring cup device which, when inverted within the nurser, can be used to expel air from the collapsible bag. As in the case of the Lebeau device, however, when the bottle is full the presence of the inverted cup essentially doubles the effective length of the bottle.

Therefore, the need exists for a simple, straightforward device for expelling air from such nursing bottles which avoids the complexities apparent in the prior art and instead focuses on the straightforward tasks of expelling air.

OBJECT AND SUMMARY OF THE INVENTION

Therefore, it is an object of the present invention to provide an improved baby nursing bottle of the type that incorporates collapsible plastic bags to hold the liquid, and which quickly and easily facilitates the removal of air from the collapsible bag and in the absence of complex mechanical systems and without increasing the overall size of the bottle.

The present invention meets this object by providing a baby nursing bottle for use in conjunction with collapsible liquid containers such as small disposable plastic bags. The baby nursing bottle of the invention comprises a cylindrical main body portion, and a pair of longitudinal slots in the main body portion that extend substantially along the length of the main body portion. A longitudinally movable plunger member is positioned within the main body portion. A pair of tab handles are connected to the plunger and extend outwardly from the slots adjacent the outer surface of the main body portion and move the plunger longitudinally within the main body portion when the tab handles are engaged and moved along the surface of the main body portion. In the preferred embodiment, the main body portion is formed of a composition that is a blend of a polymeric material and a passive light source composition for absorbing incident light when in the presence of such light and for emitting stored energy in the form of light that is particularly visible in the absence of other incident light to so that the main body portion is visibably identifiable in low light or dark environments.

The foregoing and other objects, advantages and features of the invention, and the manner in which the same are accomplished, will become more readily apparent upon consideration of the following detailed description of the invention taken in conjunction with the accompanying drawings, which illustrate preferred and exemplary embodiments and wherein:

DETAILED DESCRIPTION OF THE INVENTION

Figure 1:
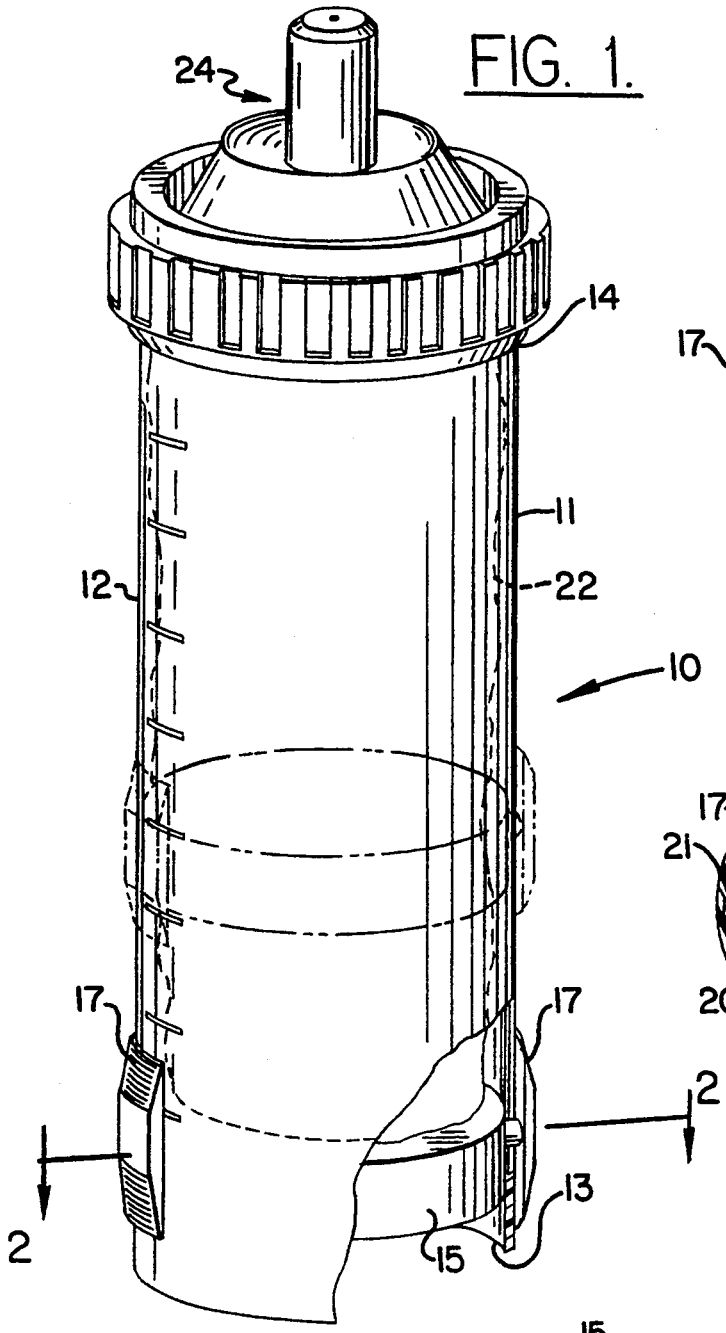
FIG. 1 is an overall perspective view of a baby nursing bottle according to the present invention.

FIG. 1 illustrates the preferred embodiment of the present invention which is broadly designated as the baby nursing bottle 10. The bottle comprises a cylindrical main body portion 11 that has a pair of longitudinal slots 12 therein. The longitudinal slots 12 extend substantially along the length of the main body portion 11. In the preferred embodiment, the longitudinal slots 12 are in opposing relationship to one another; i.e., when the bottle is circular, they are 180° apart. The cylindrical main body portion 11 is hollow and preferably formed of a polymeric material and thus defines two substantially circular end portions 13 and 14. It will be understood that for purposes of the invention, a main body portion with a polygonal cross-section would be the structural and functional equivalent of a cylinder.

In preferred embodiments the main body portion is formed of a polymeric material, and in the most preferred embodiments is formed of a polypropylene homopolymer.

As illustrated in the drawings, the longitudinal slots 12 extend substantially adjacent to, but do not reach, the respective circular end portions 13 and 14.

A longitudinally movable plunger member 15 is positioned within the main body portion. In the preferred embodiments where the main body portion 11 is a cylinder, the plunger 15 comprises a circular disk that does not extend beyond the main body portion 11 regardless of its position within the main body portion 11. This offers a number of advantages over the rather lengthy arrangements discussed with respect to the prior art.

A pair of tab handles 17 are connected to the plunger 15 and extend outwardly from the slots 12 adjacent the outer surface of the main body portion 11 for moving the plunger 15 longitudinally within the main body portion 11 when the tab handles 17 are engaged and moved along the surface of the main body portion.

Figure 2:
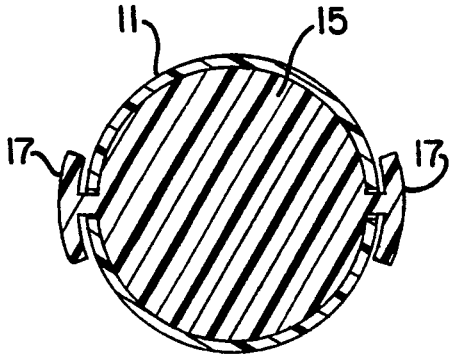
FIG. 2 is a cross sectional view taken along lines 2—2 of FIG. 1.
Figure 3:
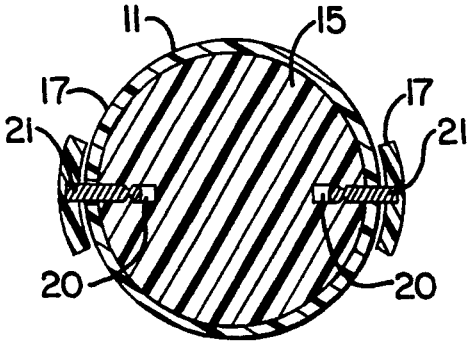
FIG. 3 is a cross sectional view similar to FIG. 2, but showing an alternative embodiment of the plunger.

In the most preferred embodiment, the tab handles 17 and plunger 15 form an integral one-piece unit (FIG. 2) in which the tab handles 17 have a generally shallow profile that helps prevent them from becoming an injury hazard when in proximity to an infant, whether feeding or not.

In another embodiment, the plunger 15 further comprises a pair of plug-receiving holes 20 that are oppositely disposed in the circumferential edge of the circular disc 15. The tab handles 17 further comprise respective plugs 21 for being received in the holes 20 so that the tab handles can be removably attached to the plunger.

It will thus be seen that because the slots 12 extend substantially along the length of the main body portion 11 to a position adjacent to, but spaced apart from, the respective circular end portions 13 and 14, and because the longitudinally movable plunger 15 has a thickness of substantially less than the length of the main body portion 11, the plunger remains entirely within the main body portion throughout the range of movement of the plunger.

Figure 4:
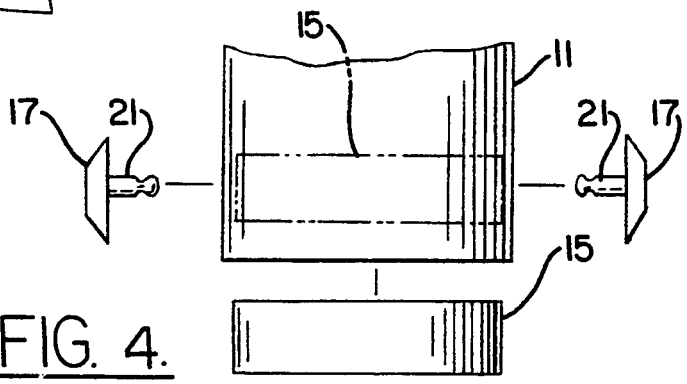
FIG. 4 is a partially exploded view of lower portions of the baby nursing bottle of the invention and illustrating an embodiment in which the tabs are removable.

FIG. 4 illustrates the ease and simplicity of construction and assembly of one embodiment of the baby nursing bottle of the present invention. In particular, the plunger 15 can merely be inserted into the circular opening 13 and when the openings 20 in the plunger 15 are aligned with the slots 12, the tab handles 17 and their respective plugs 21 can be inserted through the slots and into the holes 20 to fasten the tabs 17 to the plunger 15.

Figure 5A:
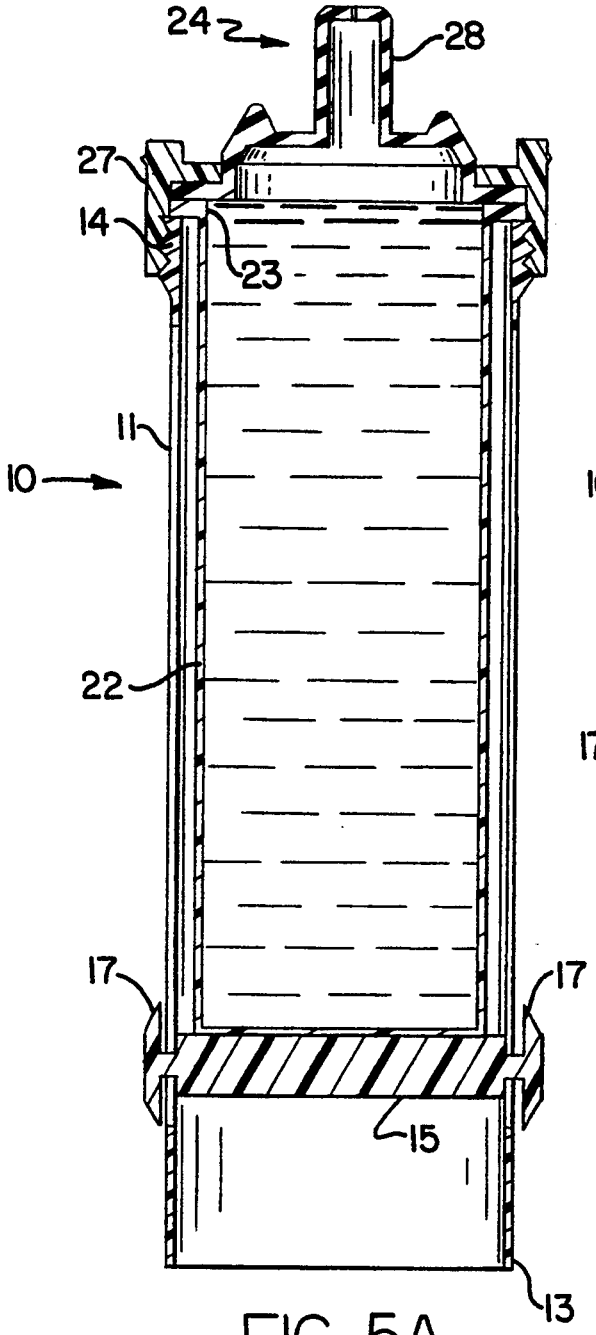
FIGS. 5A and 5B are longitudinal cross-sectional views of the baby nursing bottle according to the present invention, and showing the manner in which the plunger can be moved to help expel air from inside the bag.
Figure 5B:
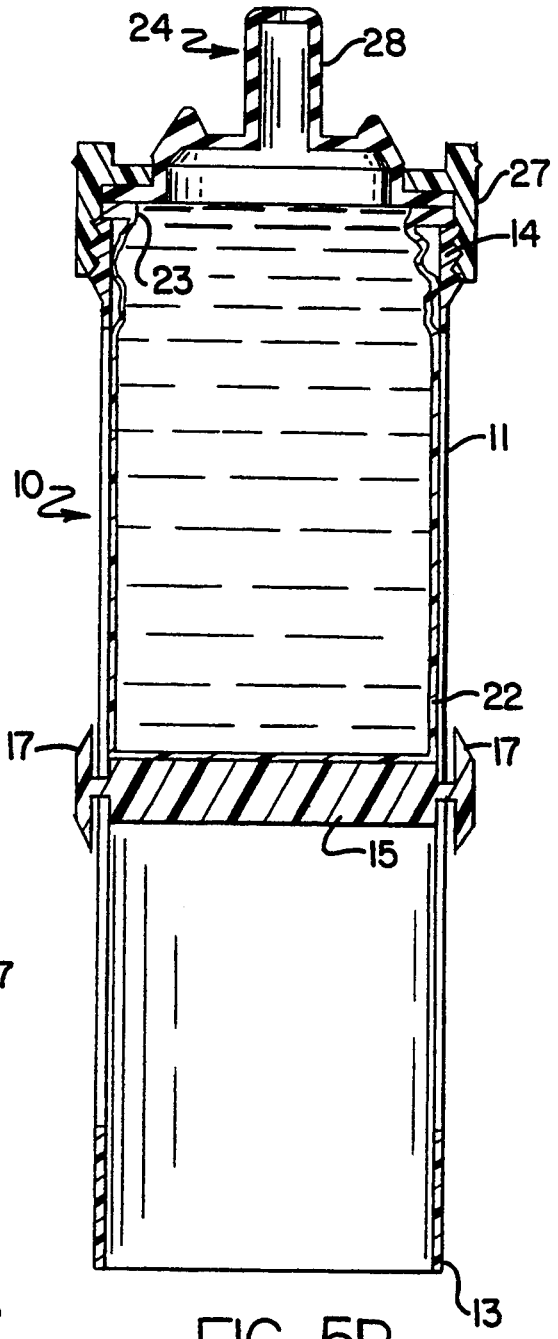

FIGS. 1, 5A and 5B also illustrate that in preferred embodiments the baby nursing bottle 10 further comprises a collapsible plastic bag 22. The collapsible bag 22 is carried within the cylindrical main body portion 11 for holding a fluid therein with the mouth 23 of the bag 22 positioned adjacent one end of the main body portion. In FIGS. 5A and 5B, the mouth 23 is illustrated as being adjacent the circular opening 14 at the top of the main body portion 11.

A nipple assembly broadly designated at 24 is removably fastened to the one end 14 of the main body portion 11 to which the mouth 23 of the bag 22 is adjacent. In FIGS. 5A and 5B, the nipple assembly 24 is shown as being threaded upon the main body portion 11 but it will be understood that any other appropriate fastening system could be used. In the illustrated embodiment, the nipple assembly 24 is formed from a threaded collar 27 and a flexible nipple 28. In preferred embodiments, the collar 27 is formed of the same material as the main body portion 11, and includes the passive light source composition. In a typical embodiment, a cap (not illustrated) could also be used to cover the nipple 28 when not in use.

It will be noted in particular that the plunger 15 is positioned in the main body portion 11 between the collapsible bag 22 and the circular end portion 13 that is not adjacent the mouth of the bag 22 so that movement of the plunger 15 against the bag will tend to collapse the bag and expel air from it (generally through the nipple 28) so that only liquid remains in the bag 22.

In a most preferred embodiment, the baby nursing bottle according to the present invention further comprises a passive light source composition blended with the polymeric material of the main body portion. In this combination the entire bottle absorbs incident light when in the presence of such light and emits stored energy in the form of light that is particularly visible in the absence of other incident light to so that the bottle is visibly identifiable in low light or dark environments.

In a preferred embodiment, the passive light source composition is a phosphorescent pigment of zinc sulfide (ZnS) and copper (Cu) that emits light in the blue-green portion of the visible spectrum. An exemplary pigment is the EXCITE 2330 inorganic phosphorescent powder available from USR Optonix Inc, Kings Highway, Box 409, Hackettstown, N.J. 07840. This pigment is particularly characterized by a coarser particle size than conventional color pigments, for example, between about 5 and 30 microns ($\mu$). Stated differently, the preferred ZnS:Cu pigment has a particle size such that approximately 99 percent passes through a 100 mesh sieve. Other related pigments emit in a number of other regions—i.e.colors—of the visible spectrum.

The preferred pigments can be mixed in conventional fashion with the polymers, preferably polypropylene, used to form the main body portion and are best incorporated with minimum milling, avoidance of acids, colorless or only slightly colored polymers, and avoidance of other metals such as lead, manganese, cobalt and the like. As with any pigment, dilution with colorless extenders or other colored pigments will reduce the intensity of the phosphorescense to an extent proportional to the amount and color of pigment or extender used.

Figure 6:
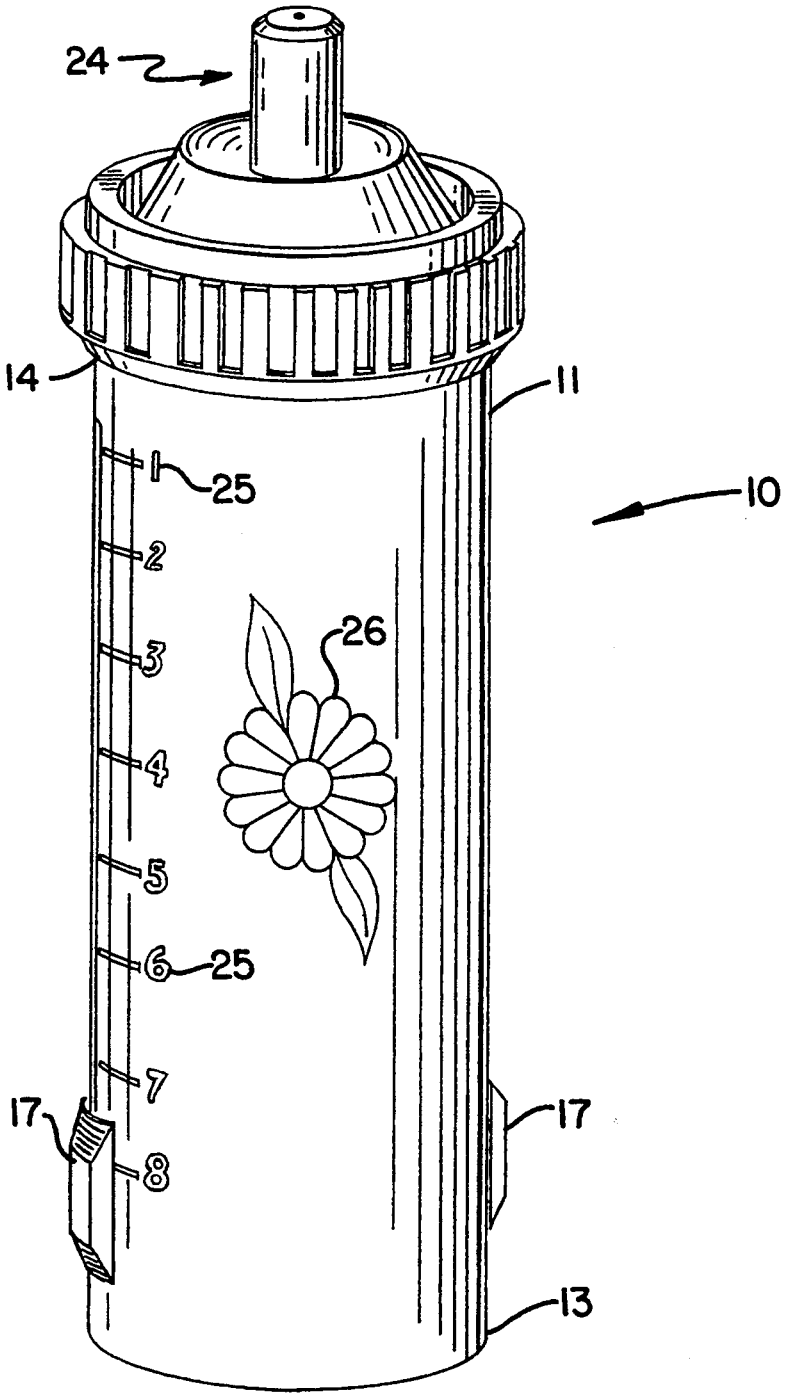
FIG. 6 is a perspective view of a baby nursing bottle according to the present invention incorporating alpha numeric legends and decorative patterns formed of a passive light source composition that is visible in the absence of ambient light.

FIG. 6 illustrates an alternative embodiment of the invention in which the passive light source composition is disposed in the form of alphanumeric information shown as the digits 25 and as the decorative design illustrated as the flower 26.

Overall, the invention provides a particularly useful combination of features. The plunger is compact, does not extend the length or other dimensions of the bottle when in use, and in one embodiment can be easily removed for cleaning or replacement. The incorporation of the passive light source composition makes the invention particularly useful in darkness or dimly lighted conditions which often accompany the late night or early morning feeding of infants.

In the drawings and specification, there have been disclosed typical preferred embodiments of the invention and, although specific terms have been employed, they have been used in a generic and descriptive sense only and not for purposes of limitation, the scope of the invention being set forth in the following claims.

That which is claimed is:

1. A baby nursing bottle for being used in conjunction with collapsible liquid containers such as small disposable plastic bags, said baby nursing bottle comprising:

a hollow cylindrical elongate main body portion that defines an inner surface and an outer surface and respective circular end portions;

a pair of longitudinal slots through said main body portion, said slots extending substantially along the length of said main body portion;

said inner surface between said slots being entirely smooth;

a longitudinally movable plunger member positioned within said main body portion; and a pair of tab handles connected to said plunger and extending outwardly through said slots adjacent said outer surface of said main body portion for moving said plunger longitudinally within said main body portion when said tab handles are engaged and moved along said outer surface of said main body portion;

said tab handles being connected to said plunger by connecting means extending radially outwardly from said plunger, said connecting means being free of contact with said inner surface at all times.

2. A baby nursing bottle according to claim 1 wherein said plunger and tabs comprise an integral unit.

3. A baby nursing bottle according to claim 1 wherein said main body portion comprises polypropylene.

4. A baby nursing bottle according to claim 1 wherein said slots extend adjacent to, but do not reach, said respective circular end portions of the main body portion.

5. A baby nursing bottle according to claim 1 wherein said plunger comprises a circular disk that defines a circumferential edge, and wherein said plunger does not extend beyond said main body portion regardless of its position within said main body portion.

6. A baby nursing bottle according to claim 5 wherein said plunger further comprises a pair of plug-receiving holes oppositely disposed in said circumferential edge of said circular disk, and said tab handles further comprise respective plugs for being received in said holes so that said tab handles can be removably attached to said plunger.

7. A baby nursing bottle according to claim 1 and further comprising:

a collapsible plastic bag carried within said cylindrical main body portion for holding a fluid therein, said bag having a mouth positioned adjacent one end of said main body portion; and a nipple assembly removably fastened to said one end of said main body portion to which said mouth of said bag is adjacent;

wherein movement of said plunger against said bag will tend to collapse said bag and expel air from said bag so that only liquid remains therein.

8. A baby nursing bottle according to claim 7 wherein said nipple assembly comprises a collar and a flexible nipple.

9. A baby nursing bottle according to claim 1, further including a composition that is a blend of a polymeric material and a passive light source composition for absorbing incident light when in the presence of such light and for emitting stored energy in the form of light that is particularly visible in the absence of other incident light so that said bottle is visibly identifiable in low light and dark environments.

10. A baby nursing bottle according to claim 9 wherein said passive light source composition comprises a phosphorescent material.

11. A baby nursing bottle according to claim 9 wherein said passive light source composition is a combination of zinc sulfide and copper.

12. A baby nursing bottle according to claim 11 wherein said passive light source composition has a particle size such that approximately 99 percent will pass through a 100 mesh screen.

13. A baby nursing bottle according to claim 11 wherein said passive light source composition has a particle size of between about 5 and 30 microns.

14. A baby nursing bottle according to claim 9 wherein said light source composition is disposed as alphanumeric words or information.

15. A baby nursing bottle according to claim 9 wherein said light source composition is disposed as a decorative design.

16. A baby nursing bottle for being used in conjunction with collapsible liquid containers such as small disposable plastic bags, said baby nursing bottle comprising:

a hollow cylindrical elongate main body portion formed of a polymeric material and defining an inner surface, an outer surface, and two circular end portions;

a pair of opposing longitudinal slots through said main body portion, said slots extending substantially along the length of said the main body portion to a position adjacent to, but spaced from said respective circular end portions;

said inner surface between said slots being entirely smooth;

a longitudinally movable circular disk plunger positioned within said main body portion and having a thickness substantially less than the length of said main body portion so that throughout its range of movement said plunger disk remains entirely within said main body portion;

a pair of tab handles connected to said plunger and extending outwardly through said opposing slots adjacent said outer surface of said main body portion for moving said plunger longitudinally within said main body portion when said tab handles are engaged and moved along said outer surface of said main body portion; and said tab handles being connected to said plunger by connecting means extending radially outwardly from said plunger, said connecting means being free of contact with said inner surface at all times.

17. A baby nursing bottle according to claim 16 and further comprising:

a collapsible plastic bag carried within said cylindrical main body portion for containing a liquid therein, said bag having a mouth adjacent one of said circular end portions; and a nipple assembly removably fastened on said circular end portion adjacent said mouth of said bag.

18. A baby nursing bottle according to claim 17 wherein said tab handles have a relatively shallow profile along said main body portion.

19. A baby nursing bottle according to claim 17 wherein said plunger is positioned between said collapsible bag and said circular end portion that is not adjacent said mouth of said bag so that movement of said plunger against said bag will tend to collapse said bag and expel air from said bag so that only liquid remains therein.

* * * * *